United States Patent [19]

Cohen

[11] 4,126,091

[45] Nov. 21, 1978

[54] FOUNTAIN BLADE AND APPARATUS FOR CALIBRATING THE SAME

[76] Inventor: Abraham N. Cohen, 1522 Elbridge St., Philadelphia, Pa. 19149

[21] Appl. No.: 753,078

[22] Filed: Dec. 21, 1976

[51] Int. Cl.[2] ..... B41F 31/02

[52] U.S. Cl. ..... 101/365; 33/172 R; 101/169

[58] Field of Search ..... 101/365, 350, 349, 363, 101/157, 169; 33/182, 169 R, 172 B, 172 R

[56] References Cited

U.S. PATENT DOCUMENTS

| | | | |
|---|---|---|---|
| 898,349 | 9/1908 | Fielding | 33/182 |
| 2,032,584 | 3/1936 | Lengel et al. | 33/182 X |
| 2,161,943 | 6/1939 | Baue | 101/365 |
| 2,351,315 | 6/1944 | Barber | 101/365 |
| 3,513,553 | 5/1970 | Dame | 33/172 B X |
| 3,570,132 | 3/1971 | Guzzo | 33/172 B |
| 3,623,430 | 11/1971 | Lessun | 101/365 |
| 3,727,550 | 4/1973 | Easoz et al. | 101/365 |

*Primary Examiner*—J. Reed Fisher

*Attorney, Agent, or Firm*—Seidel, Gonda & Goldhammer

[57] ABSTRACT

An improved fountain blade for use in printing presses is disclosed herein. The fountain blade is supported adjacent a fountain roller, such that an edge of the blade is in a substantially tangent relation to the roller. A plurality of fountain keys is supported below the fountain blade and are used to adjust the position of the edge of the blade with respect to the roller. A plate is secured to the top surface of the fountain blade in order to prevent the torquing or deflection of the fountain blade. A distance measuring instrument is slideably supported upon the fountain roller. The instrument measures the relative gap or spacing between the fountain blade and the fountain roller at any location along the fountain blade.

8 Claims, 4 Drawing Figures

FOUNTAIN BLADE AND APPARATUS FOR CALIBRATING THE SAME

BACKGROUND OF THE INVENTION

This invention relates to printing presses and more particularly to means for accurately controlling the amount of ink discharged from a printing press ink fountain to the printing press fountain roller.

In conventional printing presses, fountain keys are utilized to regulate the amount of ink which is discharged from the ink fountain into the fountain roller. This is achieved because a plurality of fountain keys are disposed along that edge of the fountain blade which lies adjacent the surface of the fountain roller. Normally, the fountain blade is biased radially outwardly from the surface of the roller and the fountain keys are used to overcome that bias to reduce the ink passageway formed between the edge of the fountain blade and the surface of the fountain roller. As the size of the ink passageway increases, a greater quantity of ink will be transferred to the ink roller and will appear on the final printed item as a relatively darker color. Conversely, when the ink passageway is reduced to its smallest size, virtually no ink is transmitted.

As is well known in the printing art, the set up of a press in order to run a printing job may, in larger presses, take a number of hours. This is because each of the many fountain keys in a particular printing press will have to be separately adjusted by the pressman before he can determine its correct setting for the job. Historically, the set up has been done on a trial and error basis, wherein each key is separately turned and adjusted until the final output is satisfactory to the pressman. The operation is repeated for every key disposed along the fountain blade.

This technique of set up includes working and reworking every fountain key along the fountain blade because there are internal stresses in the fountain blade which must be worked out by the pressman before the fountain blade can be set to run proper ink flow. This is done by working the keys to flex and unflex the fountain blade so that the blade may be finally relieved of all stresses and a uniform thickness of ink is transmitted to the fountain roller. As indicated, a great deal of time may be expended in properly setting the fountain keys for a particular run. Generally, only a very slight movement of the keys is necessary in order to obtain the desired flow of ink.

In U.S. Pat. No. 3,623,430, an apparatus for accurately determining the position of each of the fountain keys is disclosed. By use of the apparatus disclosed in this patent, the set-up time for a printing run is greatly reduced. A large calibrated dial is attached to each of the fountain keys. A pointer is provided for each of the dials, so that a pressman could note the relative position of each of the fountain keys. Thus, once a fountain blade was set up for a particular job, the positioning of each of the fountain keys could be noted then thereafter repeated if it were necessary to repeat the same job on the same press.

A problem encountered with the use of a plurality of fountain keys for adjusting the position of a fountain blade is that the fountain blade may torque during the set up processes. The torquing of a fountain blade is a commonly known problem in the printing art. The motion of a single fountain key upon a fountain blade can at times cause the fountain blade to torque or deflect, that is, twist along its entire longitudinal length or any portion thereof.

Also, when a single fountain key contacts and moves a portion of the fountain blade, it can also move not only the portion of the fountain blade adjacent the key but also any area of the blade extending to adjacent keys. This transfer of the motion of the fountain blade complicates the setting up process of the gap of the fountain blade, because the fountain key may have to be adjusted more than once to attain an accurately set gap.

BRIEF SUMMARY OF THE INVENTION

An apparatus for preventing the torque or deflection of a fountain blade is disclosed. The apparatus includes a fountain roller supported on a frame. A fountain blade is supported adjacent the fountain roller and has an edge disposed substantially tangent to the periphery of the fountain roller. A plurality of fountain keys are supported below the fountain blade and are movable toward and away from the fountain blade. The fountain keys are adapted for moving the edge of the fountain blade toward and away from the roller. A plate is secured to the top surface of the fountain blade to prevent the torquing of the fountain blade.

In the preferred embodiment, a measuring device is provided for measuring the relative gap between the fountain blade and the fountain roller along the length of the blade. The actual gap between the fountain roller and the fountain blade cannot be determined because the actual point when the fountain blade initially contacts the fountain roller cannot be accurately determined prior to placing ink in the fountain. The abovementioned relative gap refers to any difference in the spacing between the fountain blade and the fountain roller at various points along the length of the roller. The measuring apparatus includes a carrier arm supported on the fountain roller for sliding motion along its longitudinal dimension. The carrier arm supports a distance measuring instrument upon its upper surface. A pivotable arm is supported by the carrier arm and has one portion in contact with the front top edge of the fountain blade adjacent the fountain roller. A second portion of the pivotable arm contacts the distance measuring instrument. As the fountain blade is moved toward and away from the fountain roller, the arm will pivot and the distance which the fountain blade moves at the point of contact with the pivotable arm will be indicated upon the distance measuring instrument. Since the carrier arm is slideable along the entire length of the fountain roller, the relative gap between the fountain roller and the fountain blade can be measured at any point along the entire length of the fountain blade.

It is an object of the invention to provide a means for preventing the torquing of a fountain blade.

It is another object of the invention to provide a top pressure fountain plate for covering a portion of the top surface of a fountain blade.

It is still a further object of the invention to provide a means for measuring the relative gap between a fountain blade and a fountain roller at various locations along the length of the fountain blade.

Further objects of the invention will appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
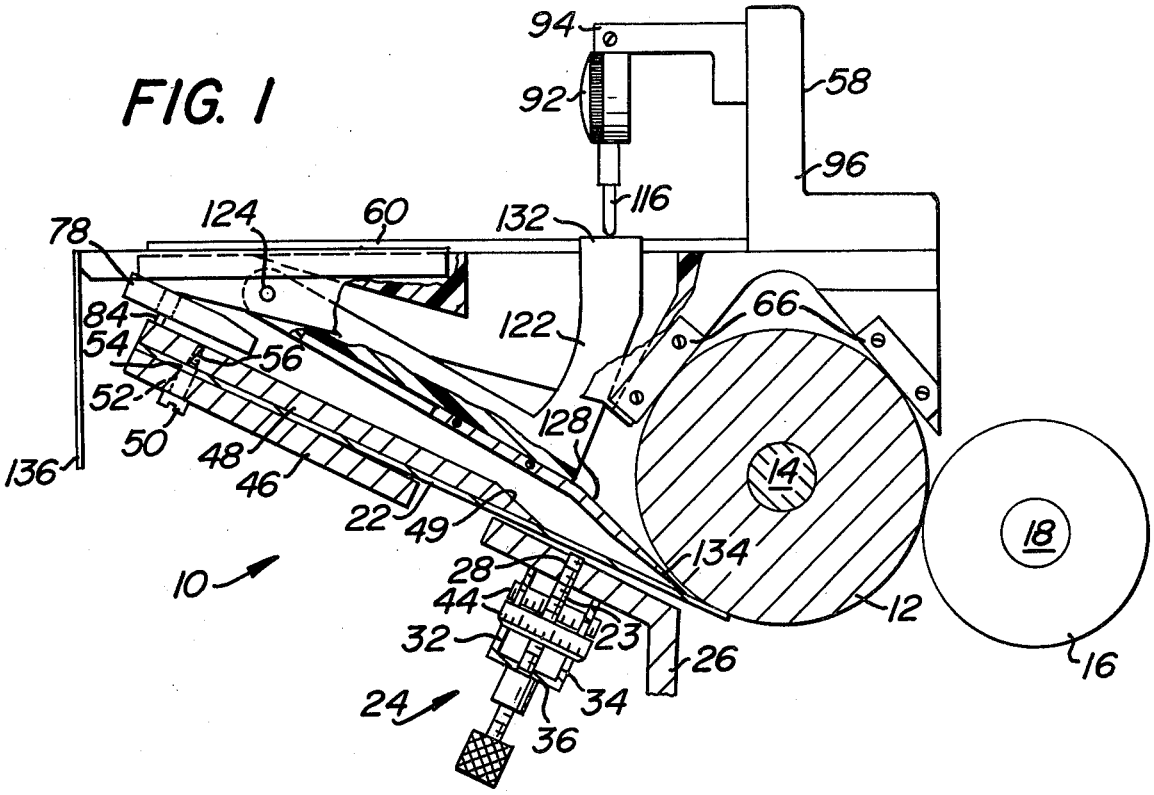
FIG. 1 is a side sectional view partly broken away of an ink fountain of a printing press having a pressure plate secured to the top of a fountain blade and a gap measuring device secured thereto.

Referring to the drawings in detail, wherein like numerals indicate like elements, FIG. 1 shows an ink fountain 10 of the type which may form a portion of a conventional printing press.

The ink fountain 10 may include a fountain roller 12. The fountain roller 12 is fixed to a shaft 14 which is mounted for rotary motion to a frame (not shown). The fountain roller 12 cooperates with an ink ductor 16 which is reciprocated into and out of contact with the fountain roller 12 in a conventional manner. The ductor 16 is supported on a shaft 18 which may be journaled in a suitable rocker arm assembly adjacent the side frames of the press. The construction of the printing press itself is conventional and thus will not be shown in detail.

A fountain blade 22 is provided for cooperating with the fountain roller 12. A quantity of ink is supported in the ink fountain 10 between the fountain blade 22 and the fountain roller 12. The flow of ink onto the fountain roller 12 is determined by the position of the fountain blade 22 which is usually composed of steel and is biased radially outward from the fountain roller 12. The fountain plate 22 is supported by the frame of the printing press in any conventional manner.

A plurality of fountain keys 24 are disposed below and along the front edge fountain blade 22 which is adjacent the fountain roller 12. The fountain keys 24 cooperate with the fountain blade 22 in order to control the orifice or gap between the fountain blade 22 and the fountain roller 12. In this manner, the amount of ink transferred to the fountain roller 12 is controlled. A carrier member or ledge 26 extends parallel to the fountain roller 12 and is supported by the printing press frame. The ledge 26 is provided with a plurality of threaded openings 28. The openings 28 are disposed in a linear, closely spaced array along the entire length of the ledge 26. The fountain keys 24 have a threaded shaft portion 23. The fountain keys 24 are usually arranged so that a threaded portion 23 of each key 24 is threadingly received into one of the threaded openings 28. A housing 30 in the form of an elongated hollow member is supported adjacent the bottom of the ledge 26. The housing 30 may be attached either to the ledge 26 or to the frame of the printing press. The housing includes a top wall 32, a bottom wall 34 and a front wall 36.

Figure 2:
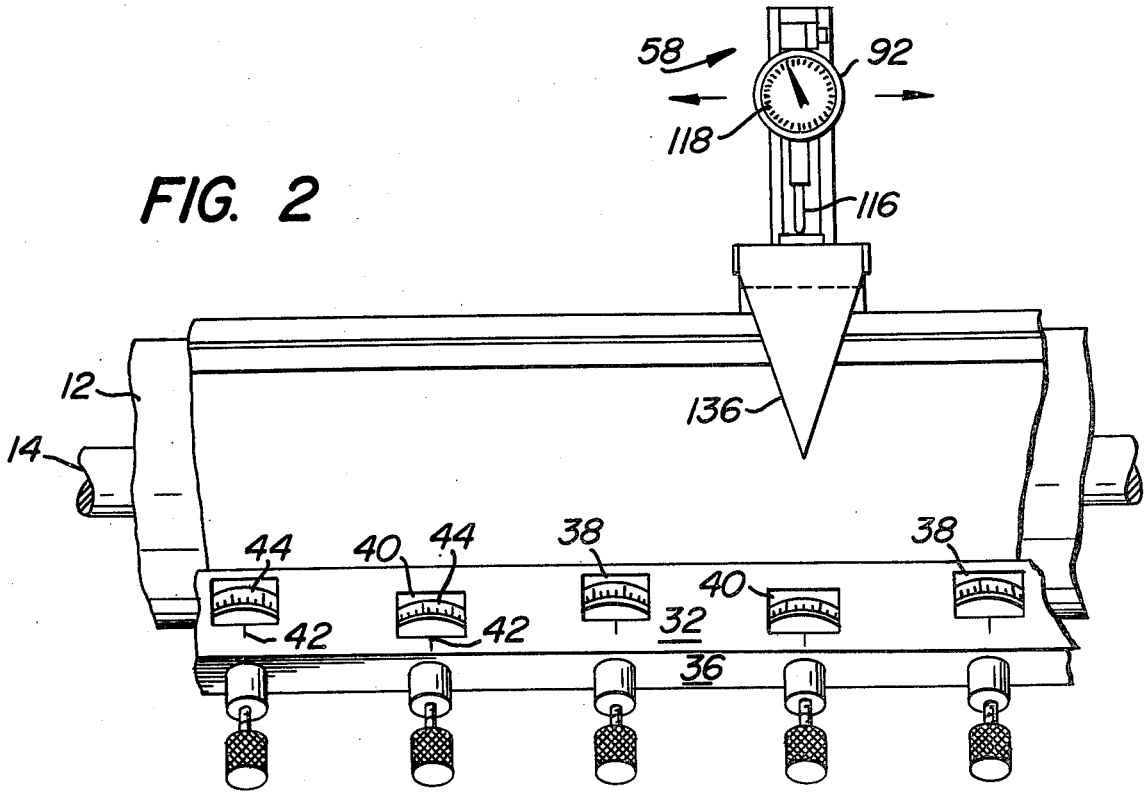
FIG. 2 is a front elevational view of the present invention.
Figures 3, 4:
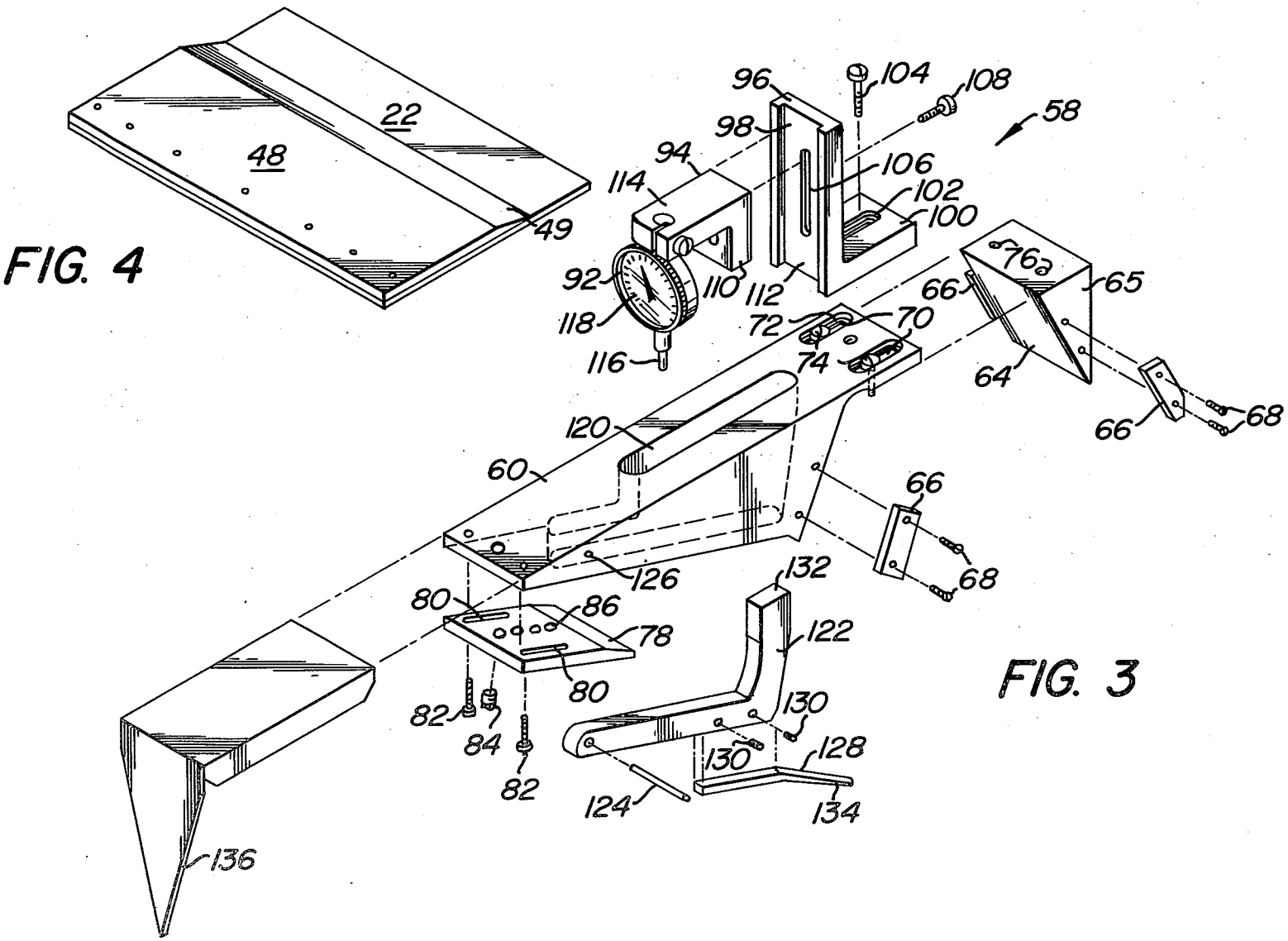
FIG. 3 is an exploded perspective view of the measuring device of the present invention.
FIG. 4 is a perspective view illustrating the fountain pressure plate and fountain blade of the present invention.

The top wall 32, as shown in FIG. 2, is provided with a plurality of regularly spaced alternately staggered apertures, arranged so that a first group of apertures 38 are relatively close to the ledge 26. A second group of apertures 40 are intermediate the first group of apertures 38 and the front wall 36. Each aperture 38, 40 is provided with an indexing mark 42.

Each of the fountain keys 24 has a dial 44 fixed to it. Each dial 44 is held in position on a fountain key 24 in any suitable manner such as by a set screw or Allen nut. The dials 44 on adjacent fountain keys 24 are staggered so that adjacent dials 44 are displaced axially with respect to each other. By virtue of this arrangement, each of the dials 44 corresponds to one of the aforementioned apertures 38 and 40 in the top wall 34 of the housing 30 and its periphery is visible therethrough. Preferably, the periphery of the dials 44 extend through the apertures 38, 40 to permit calibrations thereon to be read against the indexing marks 42. For a more complete discussion of the construction and operation of the fountain keys 24, reference is made to U.S. Pat. No. 3,623,430, the disclosure of which is incorporated herein by reference.

As shown in FIG. 1, the fountain blade 22 may have a backing plate 46 secured to its bottom surface. The backing plate 46 is not critical to the operation of the present invention and may be eliminated if desired. A pressure plate 48 is secured to the top of the fountain blade 22. The pressure plate 48 extends along at least substantially the entire length of the fountain blade 22. The pressure plate 48 also preferably extends along a major portion of the width of the fountain blade 22. The longitudinal edge 49 of the pressure plate 48 is beveled in the direction toward the roller 12. Preferably, the edge 49 is generally parallel with the edge of the fountain blade 22 which is adjacent the fountain roller 12.

There is illustrated in the figures a pressure plate 48 having a certain thickness and size with respect to the fountain blade 22. It is understood, however, that the specific thickness and specific width of the pressure plate 48, as well as the specific material of which the plate 48 is formed, depends upon the specific construction of the fountain blade 22 with which the pressure plate 48 is used. That is, the thickness, width and material of the pressure plate 48 depends upon the specific size of the fountain blade 22 and specific material out of which the fountain blade 22 is constructed. However, the specific size of the pressure plate 48 must be such that it will prevent the torquing and deflection of the fountain blade 22.

The pressure plate 48 is secured to the fountain blade 22, and the backing plate 46, if such a backing plate 46 is utilized, by any suitable means. In FIG. 1, one preferred method of securing the plate 48 is illustrated. A screw 50 is passed through a bore 52 within the backing plate 46 and a bore 54 in the fountain blade 22, and threads into a threaded hole 56 within the pressure plate 48. Other suitable methods of securing the pressure plate 48 to the fountain blade 22 could be utilized, such as welding, clamping, glueing, nuts and bolts or any other means. The pressure plate 48 is secured to the top of the fountain blade 22 in such a manner so as to exert equal pressure along the entire length of the fountain blade 22.

The utilization of the pressure plate 48 prevents the torquing of the fountain blade 22 and localizes the fountain key pressure on the fountain blade 22 and the movement of the fountain blade 22 to the particular area of the blade adjacent each respective fountain key 24.

A measuring apparatus 58 is provided for measuring the relative gap between the fountain blade 22 and the fountain roller 12 along various locations of the blade 22. The measuring apparatus 58 includes a carrier arm 60, which is adapted to be slideably received on the fountain roller 12. A pair of sloping surfaces 62, 64 extend from the bottom of the carrier arm 60. Each of the surfaces 62, 64 has bearing plates 66 extending therefrom which are adapted to contact the fountain roller 12. The bearing plates 66 are preferably made of a soft metal such as brass. The bearing plates 66 are removably secured to the carrier arm 60 by screws 68. Thus, once the bearings have worn down, they can be easily replaced. While the bearing plates 66 preferaby provide the contact surfaces with the roller 12, they may be eliminated and the surfaces 62, 64 would contact the roller 12 directly.

The sloping surface 64 forms one face of a triangular block 65. The position of the sloping surface 64 is adjustable along the lengthwise dimension of the carrier arm 60. A pair of elongated slots 70 extend through the carrier arm 60 adjacent one of its ends. The slots 70 extend longitudinally of the arm 60 and have flanges 72. A screw 74 extends through each of the slots 70 and threads into a threaded hole 76 within the block 65. The heads of the screws 74 fit within the slot 70 and rest upon the flange 72. In this manner, the top surface of the carrier arm 60 is free of any projections. Thus, the position of the sloping surface 64 with respect to the sloping surface 62 can be adjusted by changing the position of the block 65. The carrier arm 60 can thereby be adapted to fit upon fountain rollers 12 which have various diameters.

A plate 78 is secured to the bottom of the carrier arm 60 adjacent the longitudinal end opposite that of the surfaces 62, 64. The plate 78 has a pair of elongated slots 80 extending therethrough and is secured to the carrier arm 60 by a pair of screws 82 passing through the slots 80 and threading into the carrier arm 60. Due to the elongated slots 80, the position of the plate 78 with respect to the carrier arm 60 can be adjusted. A screw 84 is secured within one of a plurality of holes 86, which extend through the plate 78. The position of the screw 84 with respect to the plate 78 can thereby be adjusted. As best seen in FIG. 1, one end of the screw 84 rests upon the rear top surface of pressure plate 48. The screw 84 is thus utilized to support the measuring apparatus 58 along the rear top surface of the pressure plate 48. Since the position of the plate 80 and the bushing 84 can be adjusted, the measuring apparatus 58 can be utilized with printing presses having various sized fountain blades.

A distance measuring instrument 92 is supported above the top surface of the carrier arm 60. The measuring instrument 92 is supported above the carrier arm 60 by means of a pair of angled arms 94, 96. The angled arm 96 has an extension 100 which rests upon the top surface of the carrier arm 60 and an extension 98 generally perpendicular thereto. The extension 100 has an elongated slot 102 extending through it. A screw 104 passing through the slot 102 threads into a hole within the carrier arm 60 to thereby secure the angled arm 96 to the carrier arm 60. Due to the elongated slot 102, the position of the angled arm 96 with respect to the carrier arm 60 can be adjusted. An elongated slot 106 extends through the extension 98. A screw 108 passes through the slot 106 and threads into a threaded hole within the angled arm 94. A vertical extension 110 of the angled arm 94 is slideably received within a recess 112 within the extension 98 of the angled arm 96. Once a proper horizontal position is selected for the angled arm 94, the screw 108 can be threaded into the angled arm 94 to thereby secure the angled arm 94 to the angled arm 96.

The measuring instrument 92 is secured to and extends downwardly from a horizontal extension 114 of the angled arm 94. The measuring instrument 92 has a linearly displaceable projection 116. The relative position of the projection 116 is read upon a scale 118 of the measuring insturment 92. Scale 118 is preferably calibrated to increments of less than thousandths of an inch. A slot 120 extends completely through the carrier arm 60 and is adapted to receive a pivoting arm 122. The pivoting arm 122 pivots about an axle 124 which is fixedly secured within holes 126 within the carrier arm 60. The pivoting arm 122 has a feeler arm 128 which fits within a recess within the bottom of pivoting arm 122 and is removably secured thereto by a pair of set screws 130.

By utlization of the pressure plate 48 and the measuring apparatus 52, in conjunction with a fountain key mechanism as disclosed in U.S. Pat. No. 3,623,430, an extremely simplified method of setting up a fountain blade 22 is attained. All of the fountain keys 24 are initially backed away from the fountain blade 22 so that no fountain keys 24 are in contact with the fountain blade 22. The fountain blade 22 is thus considered a relaxed blade. Thereafter, an approximate gap is set between the fountain blade 22 and the fountain roller 12. The gap is set without any of the fountain keys 24 coming into contact with the fountain blade 22 in a conventional manner by adjusting the position of the fountain blade 22 within its frame. A feeler gauge is utilized to attain an approximately even gap such as 0.040 of an inch, the gap chosen will vary from press to press, along the entire length of the fountain blade. The gap set with a feeler gauge is only an approximation and does not produce an accurate enough gap.

With the fountain blade 22 still in its relaxed condition, the measuring instrument 58 is utilized to measure the relative gap between the fountain blade 22 and the fountain roller 12 along various locations of the fountain blade 22. The measuring instrument 58 is aligned with a fountain key 24 by aligning a pointer 136 with a fountain key 24 and noting the indication on the measuring instrument 92. The measuring apparatus 58 is thereafter moved to another location and the relative position of the fountain blade is also measured at this new position. Any change in the position of the fountain blade 22 moves the feeler arm 128 and hence the pivoting arm 122 about its pivot point. The amount of this motion will be registered on the dial 118 because the surface 132 will displace the projection 116. This process is continued for all of the locations on the fountain blade 22 adjacent a fountain key 24 and the reading upon the measuring instrument 92 is noted at each location. In this manner, the relaxed contour or error in the fountain blade 22 is measured.

The area of the fountain blade having the highest error, that is, indicated as being closest to the fountain roller 12, is moved closer to the fountain blade by a certain specified point. Any specified point may be chosen such as 0.020, 0.025 of an inch, etc., as indicated on the measuring apparatus 58. This specified point is measured and indicated by the measuring apparatus 58. Thereafter, each of the remaining fountain keys 24 is moved into the fountain blade 22 until the measuring apparatus 58 indicates that the fountain blade is at the specified point adjacent the key being moved. This process is repeated at each of the fountain key locations. Thus, the measuring apparatus 58 will indicate that the fountain blade 22 is evenly spaced from the fountain roller 12 along its entire length. If the fountain roller 12 and fountain blade 22 were perfectly manufactured and perfectly aligned within its frame, a perfect gap will now have been set.

As disclosed in the afore-mentioned patent, each of the fountain keys 24 has a movable dial thereon. Once the above gap or height has been set, the dials can be adjusted to indicate zero. With the fountain keys and dials attached to a specific press, the amount each gap is closed by each increment of rotation as indicated on the dials is known. Thus, a pressman can tell exactly how many thousandths of an inch or any portion thereof he is opening and closing a gap, merely by reading the dial on the fountain keys 24.

Once the above gap has been set, ink is placed in the fountain 10 to determine the zero setting (that is, where no ink flows onto the fountain roller 12). This is determined by adjusting a single fountain key 24 until no ink flows from the area adjacent this fountain key 24. Thereafter, each fountain key 24 can be adjusted to such a position. This is known as a true zero setting.

The present invention may be embodied in other specific forms without departing from the spirit or essential attributes thereof and, accordingly, reference should be made to the appended claims, rather than to the foregoing specification as indicating the scope of the invention

I claim:

1. An apparatus for accurately measuring the relative gap between a fountain blade and a fountain roller at various locations along said fountain blade comprising:

a distance measuring instrument having a displaceable projection and a calibrated indicator for indicating the relative displacement of said projection;

means for supporting said measuring instrument;

said supporting means including a surface for resting on the surface of said roller, said surface being slideable along the longitudinal length of said roller;

an arm carried for pivotable motion by said support means;

a portion of said pivotable arm contacting said fountain blade and a second portion of said pivotable arm contacting said projection of said measuring instrument.

2. An apparatus in accordance with claim 1 wherein said support means includes an elongated carrier arm, said carrier arm having a first sloping surface for resting upon a portion of the circumference of said roller and a removable second sloping surface for resting upon another portion of the circumference of said roller, the position of said second sloping surface being adjustable along the length of the arm to thereby allow the carrier arm to be slideably received on rollers of various diameters.

3. An apparatus in accordance with claim 2 wherein said measuring instrument is supported on the top surface of said carrier arm, said carrier arm having a slot extending completely therethrough and said second portion of said pivoting arm adapted to move within said slot and to contact said projection.

4. An apparatus in accordance with claim 2 wherein said first and second sloping surfaces each include wear pads for contacting the circumferential surfaces of said roller.

5. An apparatus in accordance with claim 2 including a pointing means attached to the longitudinal end of said carrier arm distant from said roller.

6. An apparatus for measuring the relative gap between a fountain blade and a fountain roller at various locations along said fountain blade comprising:

a carrier arm;

means for supporting said carrier arm above a fountain roller and fountain blade for slideable motion along the length of the roller;

a distance measuring instrument supported by said carrier arm, said instrument having a displaceable projection and a calibrated indicator for indicating the relative displacement of said projection; and a pivotable arm supported for pivoting motion by said carrier arm, said arm having a first portion for contacting said fountain blade and a second portion for contacting the projection of said distance measuring instrument.

7. Apparatus in accordance with claim 6 wherein said means for supporting said carrier arm includes surfaces connected to said carrier arm for resting upon said fountain roller and a member connected to said carrier arm for resting upon said fountain blade.

8. Apparatus in accordance with claim 6 wherein said means for supporting said carrier arm includes surfaces connected to said carrier arm for resting upon said fountain blade and a member connected to said carrier arm for resting upon a surface connected to said fountain blade.

* * * * *